United States Patent [19]

Anderson

[11] Patent Number: 4,588,203

[45] Date of Patent: May 13, 1986

[54] RETRACTABLE WHEEL STRUT ASSEMBLY

[76] Inventor: Milan B. Anderson, 1225 Frontage Rd. - Space 7, Chula Vista, Calif. 92011

[21] Appl. No.: 658,583

[22] Filed: Oct. 9, 1984

[51] Int. Cl.[4] ..... B63C 1/00

[52] U.S. Cl. ..... 280/47.13 B; 16/34; 114/344

[58] Field of Search ..... 114/344; 248/293; 280/47.13 B, 414.2, 43, 645, 646, 11; 16/32, 34, 35 R, 334, 370

[56] References Cited

U.S. PATENT DOCUMENTS

| | | | |
|---|---|---|---|
| 1,999,106 | 4/1935 | Muller | 16/34 |
| 3,135,975 | 6/1964 | Andranigian | 114/344 |
| 3,499,177 | 3/1970 | Wolfe | 114/344 |
| 3,558,157 | 1/1971 | Neumann | 280/47.24 X |
| 3,616,474 | 11/1971 | Lindblad | 280/47.13 B |
| 4,092,760 | 6/1978 | Loewe | 16/35 R |
| 4,506,897 | 3/1985 | Libit | 280/646 X |

*Primary Examiner*—Joseph F. Peters, Jr.
*Assistant Examiner*—Michael Mar
*Attorney, Agent, or Firm*—Frank D. Gilliam

[57] ABSTRACT

A retractable wheel assembly for attachment to a boat or other objects to be transported over a hard surface. The assembly comprises a mounting bracket for mounting to the object to be transported. A wheel strut having foldable arm portions pivotally connected to the mounting bracket, a first lock assembly for locking the folded arm portions in a stowed or wheel deployable position and a second lock assembly for locking the arms in both a wheel stowed position and in a wheel deployed position.

10 Claims, 6 Drawing Figures

RETRACTABLE WHEEL STRUT ASSEMBLY

BACKGROUND OF THE INVENTION

The invention relates to wheel struts and more particularly to foldable wheels struts which can be folded to an out of the way stowed position when the wheel support for an object to which it is attached is not required and to a use deployed position for wheeled support of that object.

The wheel struts are used in pairs attached to the transom of a small boat to facilitate the transporting of that boat on land during launching and retrieving so as to prevent the dragging of any of the boat on sand, dirt, or like surfaces where damage to the boat is likely to occur.

There are currently wheel struts for this purpose available. These struts when stowed on the boat extend beyond the upper most surface thereof, are in the way for normal boat operations and are unsightly. To position the struts from a deployed position after boat launching it requires that the boat operator immerse his hand and arms into the water to remove the lower portion of the strut prior to normal boat operation and this operation must be reversed when the boat is retrieved for over land transport. In extreme cold waters this is obviously an uncomfortable procedure and in cloudy or dirty water, must be done by feel, which takes considerable time.

SUMMARY OF THE INVENTION

The retractable wheel assembly of the invention is mounted in pairs to the object to which it is to be used, typically a small boat, by means of a fixedly attached mounting bracket. The assembly includes a foldable strut which comprises a pair of arms. One arm is pivotally attached to the mounting bracket for pivoting the assembly in a direction parallel with the vertical center line of the boat through substantially a quarter circle (90°). The pivotal movement of this arm can be locked at each extreme direction of rotation. The other arm has a wheel at one end thereof and is pivotally attached at its other end to the other arm and to a locking lever through a link. The opposite end of the link is pivotally attached to the other arm. A locking lever provides an over center locking of the arms in either the wheel stowed or deployed position. When not in use the arms of the assembly are folded to an angled position and rotated to a position adjacent the boat transom out of the way during normal boat operation. When in a use position, the assembly is rotated from the transom adjacent position approximately 90° to an outward position and then the lower arm of the strut is rotated downward approximately 120° to a maximum strut length position. The assembly is then locked into this position. To again stow the assembly a reverse procedure is performed. It should be understood that two spaced apart assemblies are generally employed to suggest a boat or the like.

An object of this invention is to provide a wheel struct assembly which can be attached to the transom of a small boat for wheeled movement of that boat over a hard surface.

Another object of this invention is to provide a wheel strut assembly for a small boat which when in a stowed position does not affect the normal operation of the boat.

Another object of this invention is to provide a wheel strut assembly which does not affect the aesthetic appearance of the boat to which it is attached when in a stowed position.

Still another object of the invention is to provide a wheel strut assembly for use with a small boat that can be either stowed or deployed while the boat is in water without requiring the operator of the boat to come in contact with the water when repositioning the wheeled strut.

Still another object of this invention is to provide a wheel strut for use on a small boat which does not extend above the upper surface of the boat in its stowed position.

A further object of this invention is to provide a low cost retractable wheel strut for use with a small boat which will not collapse while in use.

BRIEF DESCRIPTION OF THE INVENTION

DETAILED DESCRIPTION OF THE DRAWINGS

Figure 1:
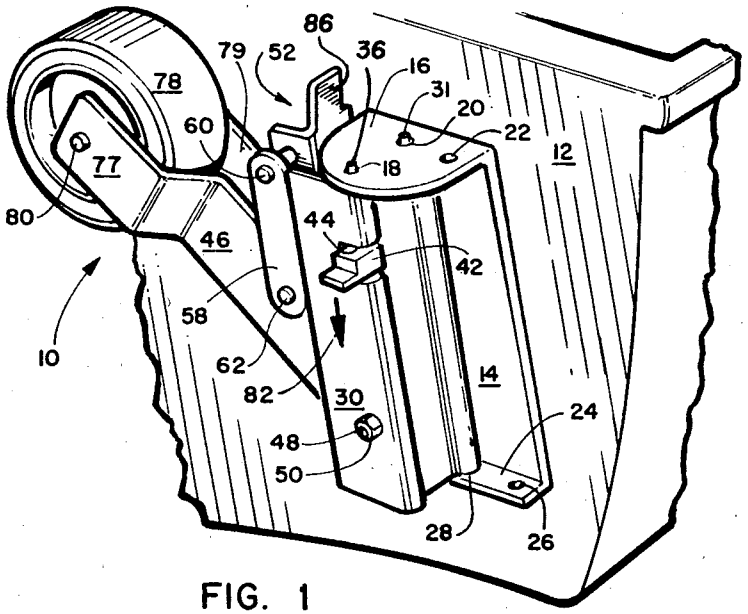
FIG. 1 is a perspective showing of the wheel strut of the invention in a fully stowed position mounted to the transom of a small boat.
Figure 2:
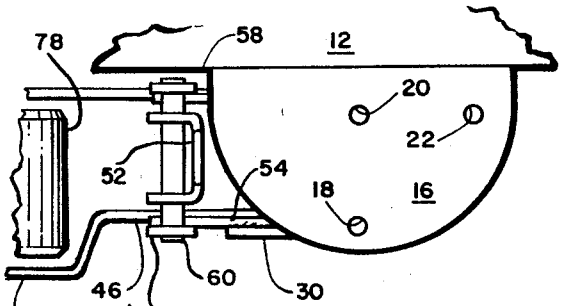
FIG. 2 is a partial plan view of FIG. 1.

Referring now to the various drawing Figures. The wheel strut assembly 10 of the invention is shown mounted on a small boat transom 12. A mounting bracket 14 is fixedly attached to the transom by any convenient means, such as, but not limited to, bolt and nut combinations, screws, welding, or the like. The only requirement of the attachment means and materials of construction is that they be suitable for the purpose intended. The mounting bracket has upper and lower outstanding surfaces 16 and 24, respectively. The upper surface 16 includes three apertures 18, 20 and 22 therethrough. The lower surface 24 includes two apertures 26 and 28 therethrough apertures 20 and 22 are in vertical alignment with apertures 28 and 26 respectfully.

Figure 5:
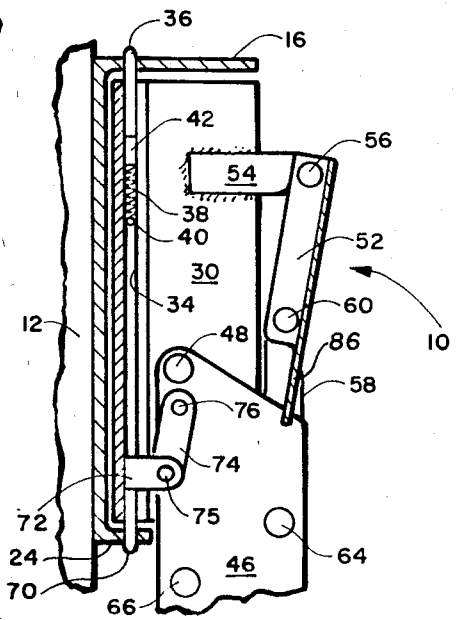
FIG. 5 is a partial cutaway showing of the wheel strut of the invention in a wheel fully deployed use position.

Pivotally attached to the mounting bracket 14 is a first "U" shaped strut portion 30. The attachment is made by a pin 31 passing through a bore 32 of strut portion 30 and extending through apertures 20 and 26 of the upper and lower surfaces respectively. On the surface 24 opposite bore 32 is a bore 34 for receiving a locking pin 36 (see FIG. 5) which is spring biased in an upward direction by a coil spring 38. Spring 38 is located in the bore 34 by means of securing pin 40 passing through and secured to the bore 34 walls. Attached to the pin 36 is an operating lever 42 protruding through an elongated slot 44 in strut portion 30. As shown in FIG. 1, pin 36 passes through aperture 18 and held in position by spring 38 preventing rotation of the first strut portion 30 about pin 31.

A second "U" shaped strut portion 46 is pivotally attached to the first strut portion 30 by means of pivot pin 48 which is secured between the sides of first strut 30 by a nut means 50 threaded on the end of the pin 48 or a rivet or the like may be used, by way of example and not by way of a limitation.

A locking bracket 52 is pivotally attached between a pair of outstanding tabs 54 extending from the sides of the first strut portion 30 by a pair of rivets 56 or the like. The opposite end of the locking bracket is pivotally attached to a link 58. The opposite end of the link 58 is pivotally attached to one side of the second strut portion 46. The link to locking bracket attachment is by means of a pivot 60 which is a rivet, bolt or the like. The second strut attachment of the link 58 is by means of pivot pin 62 which passes between the sides of the second strut and includes a spacer 64 positioned between the second strut sides. A second spacer 66 with held in place by pin 68 which like pin 62 extends between the sides of the second strut. These spacers provide rigidity between the strut sides.

A lower locking pin 70 is pivotally connected through its upper attached tab 72 to a locking link 74 through a pivot 75. The opposite end of the locking link 74 is pivotally attached to the second strut at a location adjacent to the pivot pin 48 through a pivot 76.

The free end of the second strut unit is bifurcated and has a wheel 78 rotatably connected between the bifurcations 77 and 79 by means of an axle 80.

OPERATION OF THE WHEEL STRUT

Figure 3:
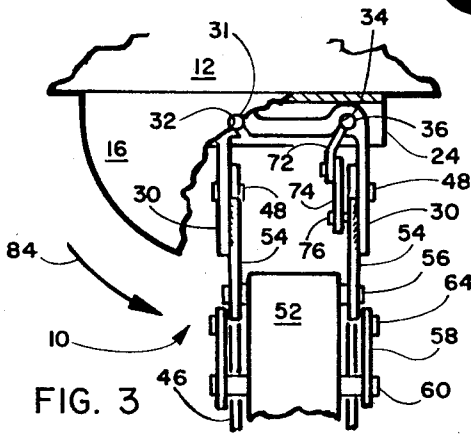
FIG. 3 is a partial plan view of FIG. 1 rotated 90° counter-clockwise from the FIG. 2 position.

Referring now specifically to FIG. 1, tab 42 is translated downward along arrow 82 against the tension of spring 38 until pin 36 clears aperture 18. The strut portions 30 and 46 are then rotated along arrow 84 (see FIG. 3) until the pin 36 aligns with aperture 22 and the spring 38 forces the pin into the aperture 22. The wheel struts are now in the wheel deployable position with the wheel still in its upward stowed position.

Figure 6:
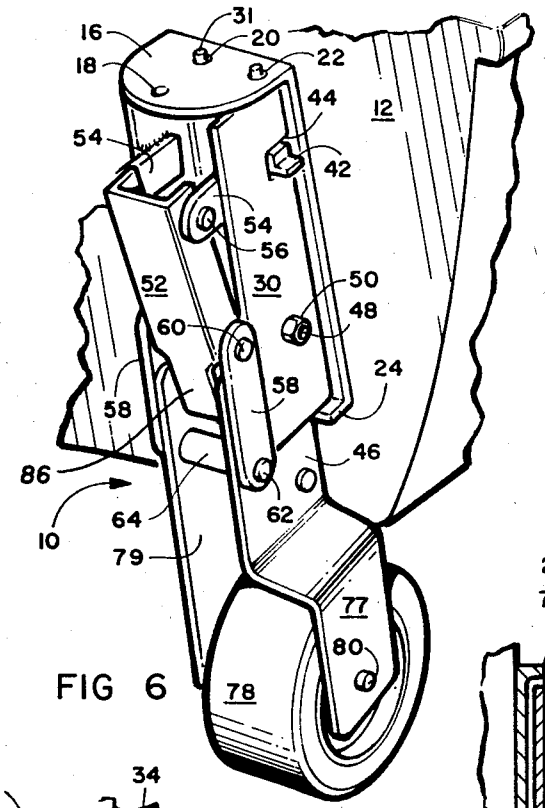
FIG. 6 is a perspective view of the wheel strut of the invention in a wheel fully deployed position.
Figure 4:
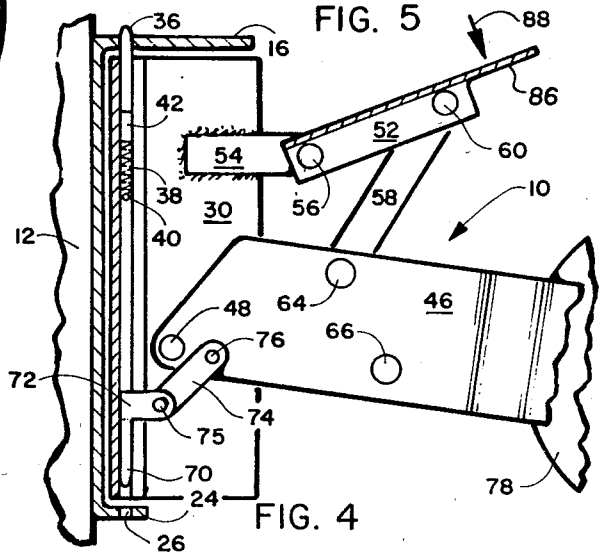
FIG. 4 is a partial cutaway side view of the wheel strut of the invention in a wheel deployable position with the wheel partially deployed to its use position.

To the place the wheel in its deployed FIG. 6 position, tab 86 on the locking bracket is pushed away from the stowed wheel to move the locking bracket 52 from its now over center locked position. After unlocking, the tab is now moved along arrow 88 (see FIG. 4) until the wheel strut is rotated to its maximum downward position as shown in FIG. 6. In the FIG. 6 position, the locking bracket 52 is again positioned in its over center wheel deployed locked position. The action of link 74 and tab 86 causes the pin 70 to extend into aperture 28 and thus provide locking as does pin 36 to prevent rotation of the first strut portion 30 from the wheel deployed position.

It should be noted that when fully stowed, as shown in FIG. 1, link 58 abutts the outer edge of its adjacent surface of first strut portion 30. This feature limits the rotation of the second strut portion 46 to a maximum angled position as shown. Further, link 58 (see FIG. 6) also abutts the same outer edge of the first strut portion and limits the downward maximum rotation of the second strut portion 46. The over center locking of locking bracket 52 is accomplished because tabs 54 extend further outward than the position of link 58 in either of its first strut portion 30 abutting positions.

To again fully stow the wheel strut assembly of the invention, the above operation is reversed.

Typically, as aforementioned, two wheel strut assemblies are employed on objects such as boats and the like. The use of two wheel strut assemblies should not be considered as limitations to its use as multi wheel assemblies a single wheel strut assemblies may be used equally as well.

It should be understood that the retractable wheel assembly of the invention is shown foldable against the transom by clockwise rotation from a wheel deployed or use position for ease of explanation and that retractable wheel struts of a mirror image configuration would rotate counter clockwise between deployed and stowed conditions. It should be obvious that for use on a small boat one retractable wheel assembly as shown and one of a mirror image would be employed so that in a stowed against the transom position both assemblies would be positioned toward each other and the vertical center line of the boat.

Other applications, variations and ramifications of the present invention will occur to those skilled in the art upon reading this disclosure. These are intended to be included within the scope of this invention, as defined in the appended claims.

What is claimed is:

1. A retractable wheel strut assembly comprising:

a single mounting bracket having upper and lower surfaces for fixedly attaching said retractable wheel strut assembly to an object to be supported thereby;

a wheel strut comprising a first arm portion pivotally attached to said mounting bracket about a vertical axis and pivotable between stowed and wheel deployable positions and a second arm portion with a wheel rotatably attached at one end thereof said second arm portion being pivotally attached to said first arm portion for pivoting about a horizontal axis between a wheel stowed and wheel deployed position;

first locking means attached to said first arm portion for locking said first arm portion to said mounting bracket to prevent rotation thereof when in said stowed and wheel deployable positions said first locking means comprising a first and a second translating pin, said first pin engaging an aperture in said upper surface of said first arm portion when in said stowed or wheel deployed positions and said second pin engaging an aperture in said lower surface when said second arm portion is in said wheel deployed position; and a second locking means positioned between said first and second arm portions for locking said second arm portion in said wheel stowed and wheel deployed positions.

2. The invention as defined in claim 1 wherein said mounting bracket has upper and lower surfaces, said surfaces are substantially parallel to each other and perpendicular to the object to which the mounting bracket is attached, said upper surface has three apertures therethrough, said lower surface has two apertures therethrough which vertically align with two of the three apertures through the upper surface, wherein said first arm portion pivotally attaches by pivot pin means to one pair of aligned opposing apertures and said first translating pin engages the other one of the three apertures in the upper surface and locks the first arm portion in its stowed position.

3. The invention as defined in claim 1 further comprising a pivotable link means which interconnects between said second locking means and said second arm portion for defining said wheel stowed and wheel deployed positions.

4. The invention as defined in claim 1 wherein the first arm portion of said wheel strut is pivotally attached to said mounting bracket at one side thereof, the opposite side of said first arm carries said first locking means.

5. The invention as defined in claim 1 wherein said second arm portion travels through an arc of approximately 120° between wheel stowed and deployed positions.

6. The invention as defined in claim 1 wherein the wheel supporting end of said second arm portion is bifurcated and the wheel is supported by axle means between the bifurcations.

7. The invention as defined in claim 1 wherein said second locking means comprises a lever pivotally connected to said first arm portion at one end thereof and to a link at its opposite end thereof, said link is pivotally connected to said second arm portion.

8. The invention as defined in claim 7 wherein said link abutts an adjacent surface of said first arm portion in both said wheel stowed and deployed positions.

9. The invention as defined in claim 7 wherein said lever attachment to said first arm portion extends further outwardly than said link connection to said second arm portion thereby providing an over center locking means.

10. The invention as defined in claim 1 wherein said first translating pin is spring biased in an aperture engaging position and manually translatable against said spring bias and said second pin is connected to said second arm portion by a pivotable link therebetween, said second pin engages.

* * * * *